US005964946A

United States Patent [19]

Zanchetta et al.

[11] Patent Number: 5,964,946

[45] Date of Patent: Oct. 12, 1999

[54] APPARATUS FOR MANUFACTURING BITUMEN-BASED MEMBRANE SHEETS

[75] Inventors: Luigi Zanchetta; Romano Zanchetta, both of Negrisia, Italy

[73] Assignee: Polyglass, S.p.A, Italy

[21] Appl. No.: 08/924,364

[22] Filed: Sep. 5, 1997

Related U.S. Application Data

[62] Division of application No. 08/384,899, Feb. 7, 1995, Pat. No. 5,766,729.

[30] Foreign Application Priority Data

Mar. 1, 1994 [IT] Italy ..... MI94A0373

[51] Int. Cl.[6] ..... B05C 19/00

[52] U.S. Cl. ..... 118/663; 118/665; 118/688; 118/712; 118/35; 118/40; 118/45; 118/67; 118/68; 118/308; 118/419; 118/424

[58] Field of Search ..... 118/663–665, 688, 118/712, 35, 40, 45, 67, 68, 308, 419, 424; 427/8, 187, 201, 202, 209, 443; 156/71

[56] References Cited

U.S. PATENT DOCUMENTS

| | | | |
|---|---|---|---|
| 1,314,477 | 8/1919 | Overbury | 427/187 |
| 1,662,655 | 3/1928 | Abraham | 427/187 |
| 1,890,018 | 12/1932 | Overbury | 427/187 |
| 5,082,704 | 1/1992 | Higgins | 428/40 |
| 5,143,766 | 9/1992 | Wenz et al. | 428/40 |
| 5,206,068 | 4/1993 | Kalkanoglu | 428/143 |
| 5,283,080 | 2/1994 | Lamb et al. | 118/308 |

*Primary Examiner*—Laura Edwards
*Attorney, Agent, or Firm*—Baker & McKenzie

[57] ABSTRACT

A bitumen-based waterproofing membrane is provided with an improved edge for sealing with a contiguous membrane to provide a membrane system with improved waterproofing characteristics. A bitumen-based reinforced membrane sheet is coated with granular material to protect the membrane sheet from ultraviolet rays. However, a section of the membrane sheet is first covered with a piece of protective tape which prevents any granular material from being deposited on the lateral section of exposed bitumen beneath the tape. The membrane sheets are then cut immediately prior to the tape or at the edge of the granular coating and then rolled up. Accordingly, the lateral section of bitumen which is covered by the protective tape is on the innermost part of the rolled-up membrane sheet. During installation, the tape is removed and the exposed bitumen or selvage section is disposed below an adjacent or contiguous membrane. Heat is then applied for an easy and effective seal between two adjacent membrane sheets.

20 Claims, 2 Drawing Sheets

APPARATUS FOR MANUFACTURING BITUMEN-BASED MEMBRANE SHEETS

This is a division of application Ser. No. 08/384,899, filed Feb. 7, 1995 now U.S. Pat. No. 5,766,729.

FIELD OF THE INVENTION

This invention is related to waterproofing membranes and more specifically to bitumen-based membranes with sealing means for contiguous membranes, as well as the relevant processing system for fabricating the same.

BACKGROUND AND SUMMARY OF THE INVENTION

Bitumen-based membranes are used for waterproofing in construction. Such membranes normally feature a reinforcement made of non-woven polyester cloth or of a layer of reinforced glass such as fiberglass. One of the membrane surfaces is coated with small slate flakes of various colors, similar to granules, for protection against ultraviolet rays.

The users of these types of membranes currently face serious problems when trying to seal together contiguous membranes because of the relatively complex steps that must be carried out to connect the two contiguous or adjacent ends. Of course, if an effective seal is not attained, the membrane system will leak and not achieve its very purpose.

The purpose of this invention is to solve the above mentioned problem by creating a bitumen-based membrane with sealing means that make it possible to connect continuous membranes quickly and effectively with reduced energy consumption and excellent results.

Within the above described scope, one of the goals of the invention is to provide membranes that are impermeably sealed to adjacent or contiguous membranes in an effective and aesthetically pleasing manner.

The bitumen-based membrane that is the subject of this invention provides a reliable seal between membranes because of its unique design features.

The subject bitumen-based membrane is easy to produce because it is made of elements and materials that are available on the market. Further, the membrane of the present invention is relatively inexpensive to manufacture and install.

The task described above, the goals mentioned, as well as additional goals—which will be described hereinafter—have been achieved with a bitumen-based membrane featuring sealing means for contiguous membranes, per this invention, which consists of the following:

A bitumen-based membrane sheet, developed longitudinally, which is reinforced with a polyester non-woven cloth or with a coat of reinforced glass on one side of said membrane sheet.

One side of the membrane sheet will be coated with granular material such as small slate flakes. Said membrane sheet is characterized by the fact that it includes, at least at one of its ends, a transverse selvage which consists of a tract of exposed bitumen, free of granular material, as well as of a thin coat of polyethylene which, when heated, seals the ends of contiguous membranes together.

BRIEF DESCRIPTION OF THE DRAWINGS

Additional characteristics and advantages, which are offered by the subject invention, will be pointed out while examining one of the preferred production methods, although not the sole method, of a bitumen-based membrane as well as its processing system, which is illustrated by way of example—but not exclusively—through the enclosed drawings, where.

DETAILED DESCRIPTION OF THE DRAWINGS

Figure 3:
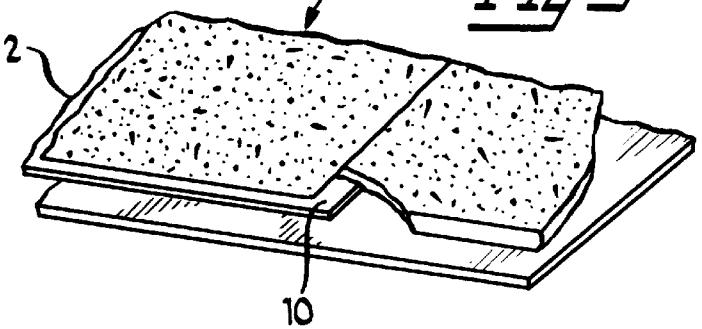
FIG. 3 schematically illustrates the membrane at the point where it is coupled to another membrane.

With reference to FIG. 3, the bitumen-based membrane includes a sheet/slab-like element 2, which is longitudinally developed and bitumen-based. The element 2 is modified with polyester and reinforced with polyester non-woven cloth 4 (see FIG. 1) or with a thin coat of reinforced glass.

One side of the sheet/slab-like element is coated with granular material such as small slate flakes of various colors (see FIG. 1), which creates a granular-type surface for protecting the sheet/slab-like element from the ultraviolet rays.

An additional benefit is the application of a transverse selvage 10. This invention is unique in that a transverse selvage 10 is placed on at least one end of the sheet/slab-like element. This provides an area free of detaching material, such as sand or talcum, as well as of slate granules.

The tape, or band 11—made of siliconized polyester—on tract 10 needs to be removed before installation.

The protective tape, or band 11 assures that at the time of installation the surface of the membrane is clean and free of slate granules, of detaching material, of any polyethylene to scorch or of any other material usually employed for packaging the rolls of membrane in order to avoid that the turns adhere to each other during storage.

The new membrane, prepared in the above described manner, reduces the time of installation and, consequently, labor costs and gas consumption. Additionally, it achieves stronger bonding between the two leading edges.

Also, the width of the selvage 10 is preferably constant, predetermined based on the set value, and it is generally orthogonal with respect to the length of the roll.

Also this factor helps installation, helps in achieving a consistent layout of the sheets; furthermore, it allows the user to achieve an impermeable and sealed surface that is more effective and more aesthetically pleasant.

Additionally, the protective tape 11 (see FIG. 1) which covers the selvage 10 assures that the surface of the roll, which is coated with small slate flakes, does not come in contact with the modified bitumen, thus preventing the selvage 10 from becoming "soiled", which would render it ineffective.

Figure 1:
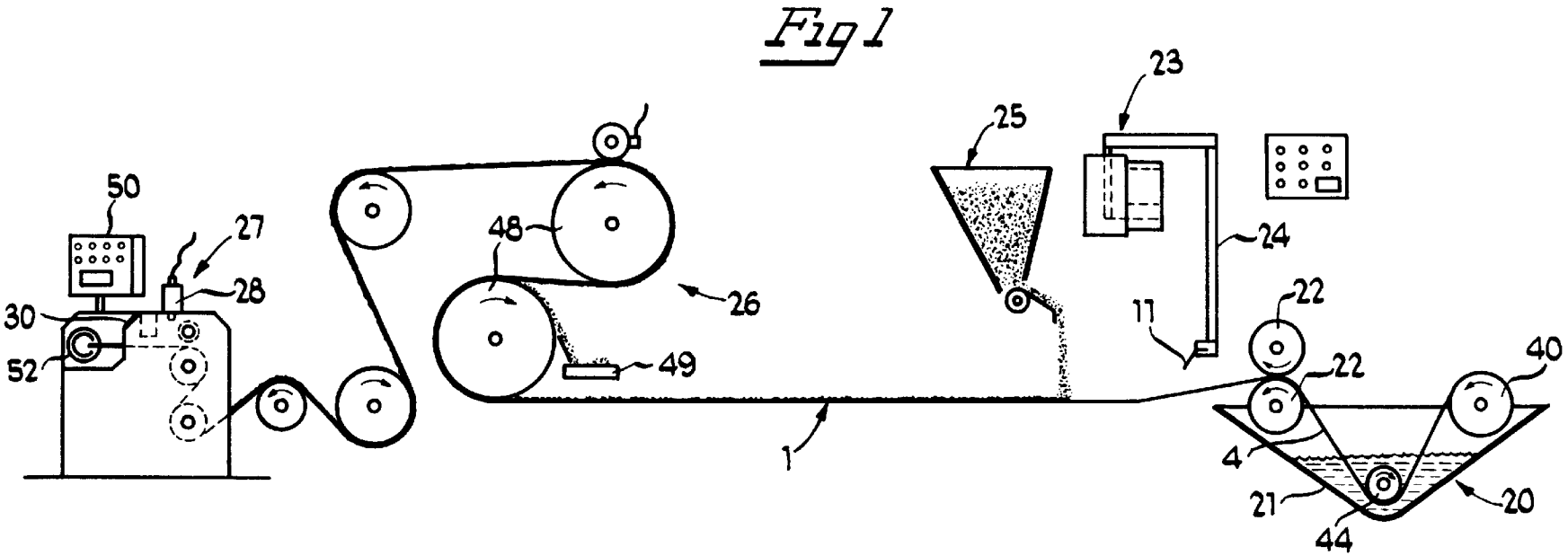
FIG. 1 schematically illustrates the front view of the processing system.
Figure 2:
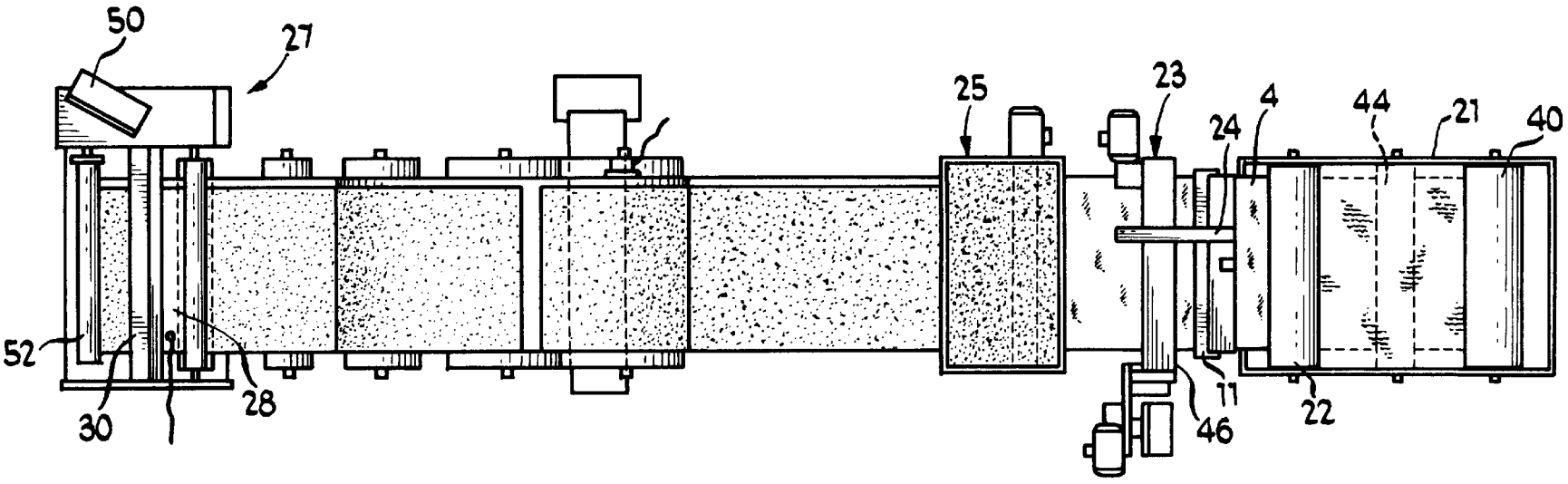
FIG. 2 illustrates the plan view of the processing system.

FIGS. 1 and 2, in particular, show the system that has been specially set up for obtaining membranes with transverse selvage, as described above.

The system includes a feed roller 40 for unrolling a roll of reinforcing cloth and a soaking unit or station 20. The soaking station 20 includes a soaking tub 21 containing liquified bitumen and a transverse roller 44 positioned below the surface of the liquified bitumen for receiving cloth from the feed roller 40 and moving the cloth through the soaking tub 21 to form a continuous longitudinal membrane sheet. The reinforcement cloth 4—made of a thin layer of reinforced glass or of polyester non-woven cloth—goes first through this soaking tub 21, then through rotary presses or pinch rollers 22, which determine the final thickness of the product.

Immediately downstream from rotary presses 22 is the tape application group 23. This group—equipped with a cutter 46 prepares the silicon polyester tapes 11.

The tape application group 23 is also equipped with a positioning arm 24, which positions the tapes in their appropriate location.

In this way, the automated arm 24 can position the tape, with very high precision, on the surface of the membrane.

Once the tape is positioned in its location, the reinforcing material 4, which is soaked with bitumen, travels underneath the granule distribution machine 25. This machine uniformly distributes granular material—in a preset quantity—on the still warm surface of the membrane in order to appropriately protect said surface.

Next, the membrane sheet 1 goes through a reclamation setup or unit 26 which recovers any excess granules. The reclamation unit 26 includes reclamation rollers 48 and a collection bin 49. The reclamation rollers 48 receive the membrane sheet from the pinch rollers 22 and invert the membrane sheet so that excess granule material from the upper surface of the membrane sheet falls off of the upper surface and into the collection bin 49.

At this point, the membrane sheet is guided to the rolling device or unit 27 where notch detector 28 is located. The notch detector reads a notch on the tape and sends a signal to a control board or controller 50.

The control board 50 instructs a membrane sheet cutter 30 to cut the sheet/slab-like element at the end of the granule coated surface and immediately before the silicon polyester tape.

At this point, the membrane is rolled up, on an uptake roller 52 sealed with tape, delivered onto a pallet, covered with shrink-wrap polyethylene, fed through the shrink-wrap oven and finally sent to storage.

Because of the above procedure, the transverse selvage is located inside the turns of the rolled membrane.

For this reason, at installation it is sufficient to unroll the membrane, remove the silicon polyester protective tape 11 and, after unrolling the second roll, weld the leading edge of this roll on the transverse selvage. This is an extremely fast and simple procedure that produces perfect couplings.

The above descriptions and explanations demonstrate that the invention achieves the set goals.

In particular, it is necessary to stress the fact that accomplishing a bitumen-based membrane, with at least one transverse selvage, on one of its ends, makes it possible to extremely simplify all the installation steps as well as the coupling procedures with contiguous membranes.

The herein described invention, so devised, can have modifications and variants applied to it, which are not beyond the scope of the protection of this invention.

Also, any detail can be substituted with other elements that are technically equivalent.

Practically, one can use any material—provided that it is compatible with the specific application—as well as any dimensions and relevant shapes, according to the requirements.

What is claimed:

1. An apparatus for manufacturing bitumen-based membrane sheets, the apparatus comprising:

means for unrolling a roll of reinforcing cloth;

means for saturating the reinforcing cloth with liquified bitumen to form a continuous longitudinal membrane sheet, the means for saturating the reinforcing cloth being located adjacent the means for unrolling a roll, and the means for saturating the reinforcing cloth receiving reinforcing cloth from the means for unrolling a roll;

means for applying a removable protective material to the membrane sheet after the membrane sheet exits from the means for saturating the reinforcing cloth, the protective material being positioned on an upper surface of the membrane sheet substantially perpendicular to the longitudinal development of the membrane sheet;

means for distributing granule material to the upper surface of the membrane sheet after the protective material has been positioned on the membrane sheet to provide a granule-coated upper surface;

means for removing excess granule material from the membrane sheet, the means for removing excess granule material being located so that excess granule material is removed after the granule material has been distributed on the membrane sheet;

means for detecting the presence of the protective material on the membrane sheet, the means for detecting being located so that the presence of the protective material is detected after the excess granule material has been removed from the membrane sheet; and means for cutting the membrane sheet at an end of the granule-coated upper surface and immediately before the protective material, the means for cutting the membrane sheet cutting the membrane sheet in response to a signal from the means for detecting.

2. The apparatus of claim 1 further including:

means for pressing the membrane sheet before applying the protective material, the means for pressing being located between the means for saturating the reinforcing cloth and the means for applying a removable protective material, the means for pressing shaping the membrane sheet so that after the membrane sheet has been pressed, the thickness of the membrane sheet equals a predetermined thickness.

3. The apparatus of claim 2 further including:

means for rolling up the membrane sheet into a roll, the means for rolling up being located adjacent the means for cutting the membrane sheet, the means for rolling up rolling the membrane sheet into a roll having a longitudinal direction after the membrane sheet has been cut.

4. The apparatus of claim 3 wherein the means for saturating the reinforcing cloth comprise a soaking unit for immersing the reinforcing cloth in liquified bitumen thereby saturating the reinforcing cloth with liquified bitumen.

5. The apparatus of claim 4 wherein the means for pressing the membrane sheet comprise a pair of pinch rollers contacting both sides of the membrane sheet after the membrane sheet emerges from the soaking unit, each pinch roller being positioned so that after the membrane sheet passes through the pinch rollers, the thickness of the membrane sheet equals a predetermined thickness.

6. The apparatus of claim 5 wherein the means for applying the removable protective material to the membrane sheet comprise a protective material cutter and a positioning arm, the protective material cutter cutting a length of the protective material, and the positioning arm affixing the length of protective material to the membrane sheet.

7. The apparatus of claim 6 wherein the means for unrolling a roll of the cloth comprise a feed roller.

8. An apparatus for manufacturing bitumen-based membrane sheets, the apparatus comprising:

a feed roller for unrolling reinforcing cloth from a roll of the cloth;

a soaking unit located adjacent the feed roller, the soaking unit receiving cloth from the feed roller and immersing the reinforcing cloth in liquified bitumen thereby saturating the reinforcing cloth with liquified bitumen to form a continuous longitudinal membrane sheet;

an applicator located adjacent the soaking unit, the applicator affixing a length of removable protective material to an upper surface of the membrane sheet after the membrane sheet exits the soaking unit, the protective material being positioned substantially perpendicular to the longitudinal development of the membrane sheet;

a material distribution unit located adjacent the applicator, the material distribution unit distributing granule material to the upper surface of the membrane sheet after the protective material has been positioned on the membrane sheet to provide a granule-coated upper surface;

a material removal unit for removing excess granule material from the membrane sheet, the material removal unit being located so that excess granule material is removed after the granule material has been distributed on the membrane sheet; and a protective material detector for detecting the presence of the protective material on the membrane sheet after the excess granule material has been removed from the membrane sheet, the protective material detector signalling a sheet cutter to cut the membrane sheet at an end of the granule-coated upper surface and immediately before the protective material.

9. The apparatus of claim 8 further including a pair of pinch rollers positioned between the soaking unit and the applicator, the pinch rollers contacting both sides of the membrane sheet after the membrane sheet emerges from the soaking unit, each pinch roller being positioned so that after the membrane sheet passes through the pinch rollers, the thickness of the membrane sheet equals a predetermined thickness.

10. The apparatus of claim 9 further including an uptake roller located adjacent the sheet cutter, the uptake roller rolling up the membrane sheet in a longitudinal direction after the membrane sheet has been cut between the end of the granule-coated upper surface and immediately before the protective material.

11. The apparatus of claim 10 wherein the soaking unit comprises a tub containing the liquified bitumen and a transverse roller disposed below the surface of the liquified bitumen, the transverse roller receiving cloth from the feed roller and moving the cloth through the tub.

12. The apparatus of claim 11 wherein the applicator comprises a protective material cutter and a positioning arm, the protective material cutter cutting a length of the protective material and the positioning arm affixing the length of protective material to the membrane sheet.

13. The apparatus of claim 12 wherein the material removal unit further includes a collection bin for holding the excess granule material removed from the membrane sheet.

14. An apparatus for manufacturing bitumen-based membrane sheets, the apparatus comprising:

a feed roller for unrolling reinforcing cloth from a roll of the cloth;

a tub containing liquified bitumen, the tub being located adjacent the feed roller, the tub including a transverse roller disposed below the surface of the liquified bitumen, the transverse roller receiving cloth from the feed roller and moving the cloth through the tub to form a continuous longitudinal membrane sheet;

a pair of pinch rollers located adjacent the tub, the pinch rollers contacting both sides of the membrane sheet after the membrane sheet emerges from the tub, each pinch roller being positioned so that after the membrane sheet passes through the pinch rollers, the thickness of the membrane sheet equals a predetermined thickness;

a tape applicator located adjacent the pair of pinch rollers, the tape applicator including a tape cutter and a positioning arm, the tape cutter cutting a length of tape and the positioning arm affixing the length of tape to an upper surface of the membrane sheet after the membrane sheet exits the pinch rollers so that the tape is positioned substantially perpendicular to the longitudinal development of the membrane sheet;

a material distribution unit located adjacent the tape applicator, the material distribution unit distributing granule material to the upper surface of the membrane sheet after the protective material has been positioned on the membrane sheet to provide a granule-coated upper surface;

a reclamation unit located adjacent the material distribution unit, the reclamation unit including a pair of reclamation rollers and a collection bin, the reclamation rollers receiving the membrane sheet from the pinch rollers and inverting the membrane sheet so that excess granule material from the upper surface of the membrane sheet falls off of the upper surface and into the collection bin; and a roller unit located adjacent the reclamation unit, the roller unit including a notch detector, a controller, a membrane sheet cutter and an uptake roller, the notch detector detecting the presence of a notch on the tape after the excess granule material has been removed from the membrane sheet, the protective material detector sending a signal to the controller, the controller in response to the signal from the notch detector signalling the membrane sheet cutter to cut the membrane sheet at an end of the granule-coated upper surface and immediately before the tape, and the uptake roller rolling up the membrane sheet in a longitudinal direction after the membrane sheet has been cut.

15. An apparatus for manufacturing bitumen-based membrane sheets, the apparatus comprising:

a feed roller for unrolling reinforcing cloth from a roll of the cloth;

a wetting unit located adjacent the feed roller, the wetting unit receiving reinforcing cloth from the feed roller and saturating the reinforcing cloth with liquified bitumen to form a continuous longitudinal membrane sheet;

an applicator located adjacent the wetting unit, the applicator affixing a length of removable protective material to an upper surface of the membrane sheet after the membrane sheet exits the wetting unit;

a material distribution unit located adjacent the applicator, the material distribution unit distributing granule material to the upper surface of the membrane sheet after the protective material has been positioned on the membrane sheet to provide a granule-coated upper surface; and a sheet cutter to cut the membrane sheet after the granule material has been distributed on the membrane sheet.

16. The apparatus of claim 15 wherein the applicator comprises a protective material cutter and a positioning arm, the protective material cutter cutting a length of the protective material and the positioning arm affixing the length of protective material to the membrane sheet, the length of protective material being positioned transverse to the longitudinal development of the membrane sheet.

17. The apparatus of claim 15 further including:

a material removal unit for removing excess granule material from the membrane sheet, the material removal unit being located adjacent the material distribution unit so that excess granule material is removed after the granule material has been distributed on the membrane sheet.

18. The apparatus of claim 17 further including:

a protective material detector for detecting the presence of the protective material on the membrane sheet after the excess granule material has been removed from the membrane sheet, the protective material detector signalling the sheet cutter to cut the membrane sheet at an end of the granule-coated upper surface and immediately before the protective material; and an uptake roller located adjacent the sheet cutter, the uptake roller rolling up the membrane sheet in a longitudinal direction after the membrane sheet has been cut.

19. The apparatus of claim 18 further including:

a pair of pinch rollers positioned between the wetting unit and the applicator, the pinch rollers contacting both sides of the membrane sheet after the membrane sheet emerges from the wetting unit, each pinch roller being positioned so that after the membrane sheet passes through the pinch rollers, the thickness of the membrane sheet equals a predetermined thickness.

20. The apparatus of claim 19 wherein the wetting unit comprises a tub containing the liquified bitumen and a transverse roller disposed below the surface of the liquified bitumen, the transverse roller receiving cloth from the feed roller and moving the cloth through the tub.

* * * * *